US006799527B2

(12) United States Patent
Kato

(10) Patent No.: US 6,799,527 B2
(45) Date of Patent: Oct. 5, 2004

(54) SEWING MACHINE SHUTTLE

(75) Inventor: Katsuyuki Kato, Ichinomiya (JP)

(73) Assignee: Kabushikikaisha Barudan, Aichi-Ken (JP)

( * ) Notice: Subject to any disclaimer, the term of this patent is extended or adjusted under 35 U.S.C. 154(b) by 0 days.

(21) Appl. No.: 10/741,991

(22) Filed: Dec. 19, 2003

(65) Prior Publication Data

US 2004/0154505 A1 Aug. 12, 2004

(30) Foreign Application Priority Data

Dec. 24, 2002 (JP) ..... 2002-373231

(51) Int. Cl.[7] ..... D05B 57/14
(52) U.S. Cl. ..... 112/232; 112/228
(58) Field of Search ..... 112/181, 187, 112/188, 189, 190, 196, 228, 230, 229, 232, 233

(56) References Cited

U.S. PATENT DOCUMENTS 2,352,598 A * 7/1944 Billington ..... 112/228
2,941,488 A * 6/1960 Attwood ..... 112/228
3,074,367 A * 1/1963 Habedank et al. ..... 112/228
3,120,204 A * 2/1964 Ketterer ..... 112/228
3,465,700 A * 9/1969 Kuhar ..... 112/228
5,048,436 A * 9/1991 Thiele ..... 112/228

FOREIGN PATENT DOCUMENTS

JP 06-327873 A1 11/1994
JP 11-244566 A1 9/1999

* cited by examiner

*Primary Examiner*—Ismael Izaguirre
(74) *Attorney, Agent, or Firm*—Darby & Darby

(57) ABSTRACT

The present invention provides a sewing machine shuttle that allows, prior to the application of an upward-pulling force from a take-up lever and without the use of this upper-pulling force, an upper thread to be pulled from an internal shuttle while sliding through the abutment between a rotation stopping recess portion and a rotation stopping projection; prevents thread breakage and inconsistency in thread tension by avoiding resistance from the upper thread when the upward-pulling force of the take-up lever is applied; and stabilizes the action of the upper thread after it has been pulled from the inner shuttle.

6 Claims, 11 Drawing Sheets

Main Shaft 115°

Main Shaft 140

Main Shaft 145°

Main Shaft 160°

SEWING MACHINE SHUTTLE

BACKGROUND OF THE INVENTION

1. Field of the Invention

The present invention relates to a sewing machine shuttle that works together with a needle and take-up lever to form stitches on fabric.

2. Description of Related Art

Japanese laid-open patent publication number Hei 6-327873 ("JP '873") describes a sewing machine shuttle as shown in FIGS. 10A–10C. This sewing machine shuttle 50 is equipped with an outer shuttle 52 rotated by a shuttle drive shaft 51 and an inner shuttle 53 housed inside the outer shuttle 52 so that rotation relative to the outer shuttle 52 is possible. A needle guide hole 54 is formed on the upper surface of the inner shuttle 53 and a rotation stopping recess portion 55 is formed on the front surface of the inner shuttle 53 in phase alignment with the hole 54. A rotation stopping projection 57 of a shuttle stopping member 56 is loosely fitted in the rotation stopping recess portion 55. The rotation stopping projection 57 stops the rotation of the inner shuttle 53. An upper thread grasping section 58 and a guide plate 59 (referred to as a "spring") are disposed on the outer perimeter of the outer shuttle 52. On the rear side, in terms of the rotation direction of the outer shuttle, is formed an upper thread advancing projection 61 for feeding the upper thread forward. The projection 61 projects forward to the front edge of the guide plate 59.

When a needle 62 rises slightly from the bottom dead center, the upper thread grasping section 58 grasps an upper thread Ta behind the needle 62. As the outer shuttle 52 rotates, an upper thread loop is formed around the inner shuttle 53. As FIG. 10A shows, as the upper thread loop expands, the upper thread advancing projection 61 pushes the upper thread Ta forward above the inner shuttle 53 so that the upper thread loop is pushed out from the outer perimeter surface of the inner shuttle 53 toward the front. As FIG. 10B shows, when the upper thread grasping section 58 reaches the lowermost section of the inner shuttle 53, the upper thread Ta enters a gap between the rotation stopping recess portion 55 and the rotation stopping projection 57. As FIG. 10C shows, the upper thread loop slides through the inner shuttle 53. When the upper thread grasping section 58 is oriented upward, a take-up lever (not shown in the figure) pulls up the upper thread Ta. This upward pulling force from the take-up lever causes the upper thread Ta to slip through the abutment of the rotation stopping recess portion 55 and the rotation stopping projection 57 toward the rear, in terms of the rotation direction of the outer shuttle, and the upper thread Ta disengages from the inner shuttle 53. Then, the upper thread Ta engages with a lower thread Tb, forming a stitch in the fabric W.

Japanese laid-open patent publication number Hei 11-244566 ("JP '566") describes a sewing machine shuttle shown in FIGS. 11A and 11B. This sewing machine shuttle 70 is equipped with an abutment section 74 disposed on the outer perimeter of an inner shuttle 71. On a shuttle-stopping member 75, there is disposed a rotation stopping projection 76 loosely fitted in a rotation stopping recess portion 72 and a stopper 77 engaging with an abutment section 74. When an outer shuttle 73 rotates, the abutment section 74 comes in contact with the stopper 77. The shuttle-stopping member 75 is attached to a shuttle support body (not shown in the figure) in a manner that allows its position to be adjusted. By adjusting, ahead of time, the abutment position of the abutment section 74 and the stopper 77, the gap between the rotation stopping recess portion 72 and the rotation stopping projection 76 can be made uniform both forward and back (in the direction of the rotation of the outer shuttle). Then, as shown in FIG. 11B, when the take-up lever pulls up the upper thread Ta, the upper thread Ta passes from front to back (relative to the rotation of the outer shuttle) through the gap between the rotation stopping recess portion 72 and the rotation stopping projection 76, passing out of the inner shuttle 71. With the sewing machine shuttle 50 of JP '873, however, an upward pulling force from the take-up lever is used on the upper thread Ta to disengage the upper thread Ta from the inner shuttle 53 by pulling it out from the abutment between the rotation stopping recess portion 55 and the rotation stopping projection 57. As a result, the upper thread Ta receives a large resistance, leading to uneven tightness in the thread or, at times, breakage due to excessive tension. With the sewing machine shuttle 70 of JP '566, a gap that is uniform both forward and back is maintained for the rotation stopping projection 76, thus allowing resistance acting on the upper thread Ta to be kept low. However, since this gap changes according to the position of the shuttle-stopping member 75, it is necessary to make tedious fine adjustments to positioning each time the shuttle-stopping member 75 is disassembled for replacement and cleaning.

SUMMARY OF THE INVENTION

The object of the present invention is to overcome the problems described above and to provide a sewing machine shuttle that allows, prior to the application of an upward-pulling force from a take-up lever and without the use of this upward-pulling force, an upper thread to be pulled from an internal shuttle while sliding through the abutment between a rotation stopping recess portion and a rotation stopping projection; prevents thread breakage and inconsistency in thread tension by avoiding resistance from the upper thread when the upward-pulling force of the take-up lever is applied; and stabilizes the action of the upper thread after it has been pulled from the inner shuttle.

In order to achieve the object described above, the sewing machine shuttle according to the present invention includes an outer shuttle rotated by a shuttle driving shaft, an inner shuttle housed in the outer shuttle rotatably relative to the outer shuttle, an upper thread grasping section disposed on the outer shuttle, a rotation stopping recess portion formed on the front side of the inner shuttle, a shuttle stopping member having a rotation stopping projection, said a rotation stopping projection being fitted loosely into the rotation stopping recess portion to allow the rotation of the inner shuttle to be stopped, and a projecting-forward upper thread release projection disposed on the front surface of the outer shuttle. While the upper thread grasping section is grasping and pulling the upper thread, the upper thread release projection pushes forward the upper thread which is dropped into the rotation stopping recess portion. This allows the upper thread to be slide out from the inner shuttle by being slid through the abutment between the rear side, in terms of the rotation of the outer shuttle, of the rotation stopping recess portion and rotation stopping projection.

In the sewing machine shuttle of the present invention, when the outer shuttle is rotated, the upper thread grasping section grasps the upper thread and an upper thread loop is formed around the inner shuttle. As the upper-thread loop is expanding, it drops into the rotation stopping recess portion of the front surface of the inner shuttle. Then, when the upper thread release projection reaches substantially same phase as the rotation stopping recess portion, the upper thread release projection pushes the upper thread forward as described above so that the upper thread slides through the abutment between the rear side, in terms of the rotation of the outer shuttle, of the rotation stopping recess portion and rotation stopping projection. In order to have the upper thread slide through the abutment with no misalignment, it would be preferable for the upper thread to be positioned near the abutment, i.e., at the rear side, in terms of the rotation of the outer shuttle of the rotation stopping recess portion.

In order to have the upper thread positioned at the rear side, in terms of the rotation of the outer shuttle, of the rotation stopping recess portion, it would be preferable for the rear side, in terms of the rotation of the outer shuttle, of the rotation stopping recess portion to be formed at a phase of 0° to 40° ahead, and, more preferably, at a phase of 3° to 30° ahead, forward in terms of the direction of rotation of the outer shuttle, of the vertical motion path of the needle (see a in FIG. 1). If the rear side, in terms of the rotation of the outer shuttle, of the rotation stopping recess portion is positioned at a phase more than 0° behind, the position within the rotation stopping recess portion of the upper thread will not be fixed. Thus, when the upper thread release projection pushes the upper thread forward, the upper thread may get caught at, for example, the tip of the rotation stopping projection so that it cannot slide through the abutment. On the other hand, if the rear side, in terms of the rotation of the outer shuttle, of the rotation stopping recess portion is positioned at a phase of more than 40° ahead, forming the rotation stopping recess portion becomes more difficult.

It would also be preferable to dispose an upper thread guide surface at the rear side, in terms of the rotation of the outer shuttle, of the rotation stopping recess portion, the upper thread guide surface being more concave further in. As a result, when the upper thread release projection pushes forward the upper thread dropped into the rotation stopping recess portion, the upper thread pushes out forward along the upper thread guide surface. This provides reliable guidance of the upper thread to the abutment between the rear side, in terms of the rotation of the outer shuttle, of the rotation stopping recess portion and the rotation stopping projection.

While the upper thread grasping section is grasping the upper thread, the upper thread release projection can use the tension on the upper thread to push the upper thread out from the rotation stopping recess portion smoothly. In order to use this upper-thread tension effectively, it would be preferable to position the upper thread release projection at a phase delay of 160° to 190° toward the rear side in terms of the direction of rotation of the outer shuttle relative to the upper thread grasping section (the position of this section changes with rotation). As a result, the upper thread is popped out toward the outer perimeter of the inner shuttle from the rotation stopping recess portion and is prevented from getting caught at the corner of the rotation stopping recess portion. After the upper thread has disengaged, the tension of the upper thread is reduced and an upper-thread loop shape can be formed in a stable manner before the upper thread is pulled up by the take-up lever.

The upper thread release projection of the present invention can also be implemented in combination with the upper thread advancing projection in JP '873. More specifically, an upper thread advancing projection is disposed on the front surface of the outer shuttle at a position in front of the upper thread release projection. Before the upper thread release projection pushes the upper thread forward, the upper thread advancing projection pushes the upper thread forward so that the upper thread is pushed toward the front side of the inner shuttle. As a result, at the initial stage of loop formation in the upper thread, the upper thread Ta applied to the outer perimeter surface of the inner shuttle is pushed toward the front side of the inner shuttle by the upper thread advancing projection so that the upper thread drops into the rotation stopping recess portion quickly. Then, the upper thread release projection can push the upper thread reliably from the rotation stopping recess portion. In order to provide accurate timing of the operations of the upper thread advancing projection and the upper thread release projection, it would be preferable to have the upper thread advancing projection positioned relative to the upper thread release projection (whose position will change with rotation) at a phase of 70°–90° ahead of the release projection, forward in terms of the direction of rotation of the outer shuttle.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENTS

Figure 1:
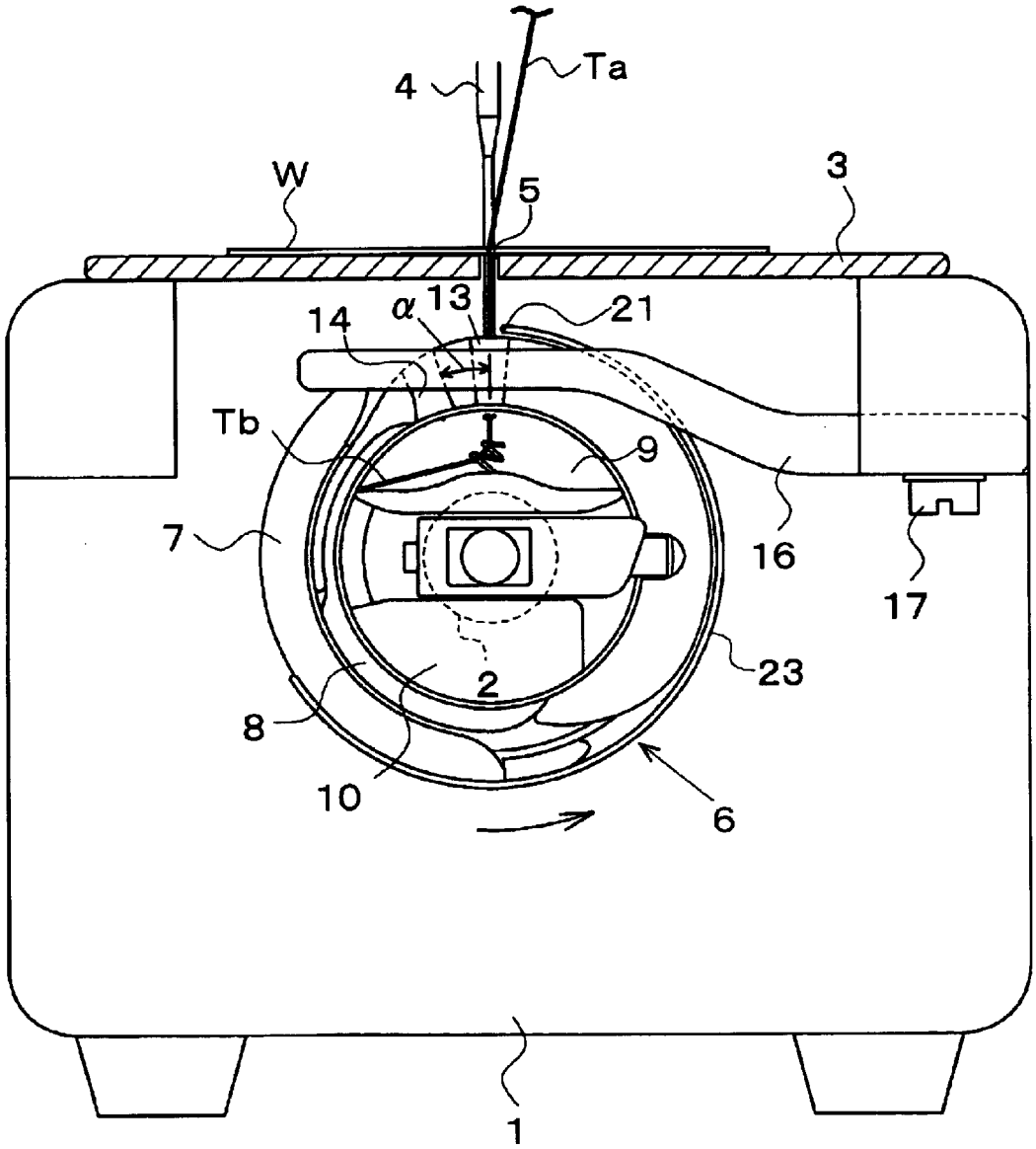
FIG. 1 is a front view of a sewing machine shuttle according to an embodiment of the present invention.

Embodiments of the present invention will be described with references to the figures. As shown in FIG. 1, in a sewing machine according to this embodiment, a shuttle drive shaft 2 is supported horizontally on the inside of a bed 1. A needle plate 3 is attached on the top surface of the bed 1. A needle hole 5 is formed on the needle plate 3 to allow a needle 4 to pass through. A take-up lever 11 (see FIG. 3) is disposed above the needle plate 3, and a sewing machine shuttle 6 is disposed below the needle plate 3. The sewing machine shuttle 6 is equipped with an outer shuttle 7 rotated by the shuttle drive shaft 2 and an inner shuttle 8 housed in the outer shuttle 7 so that the inner shuttle 8 can rotate relative to the outer shuttle 7. A bobbin case 10 housing a bobbin 9 is mounted in the inner shuttle 8. The needle 4, the sewing machine 6, and the take-up lever 11 are driven in tandem with the rotation of a main sewing machine shaft (not shown). An upper thread Ta passed through the needle 4 and a lower thread Tb wrapped around the bobbin 9 are used to form stitches on a fabric W on the needle plate 3.

Figure 2:
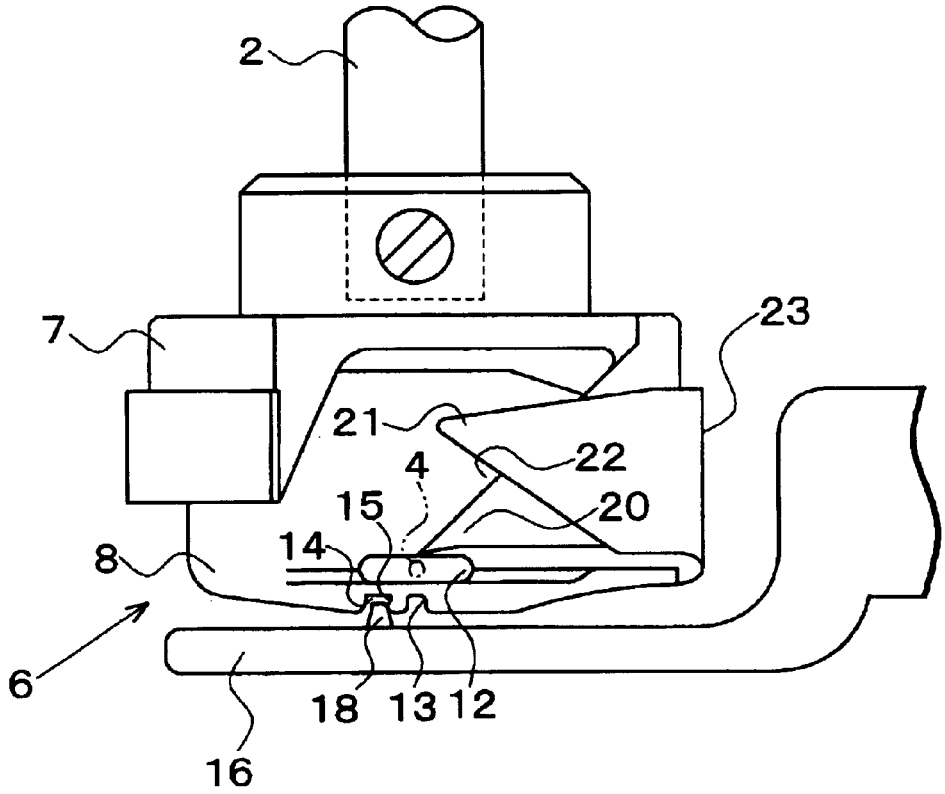
FIG. 2 is a plan view of the sewing machine shuttle according to an embodiment of the present invention.

As FIG. 1 and FIG. 2 show, a needle guide hole 12 is formed on the outer perimeter of the inner shuttle 8 to guide the needle 4 into the inner shuttle 8. A recess portion 13 is formed on the front of the inner shuttle 8 in phase alignment with the center of the needle guide hole 12 (the vertical motion path of the needle 4) in order to serve as a path for passing the lower thread Tb vertically upward. At a phase forward from, relative to the rotation direction, i.e., the direction of the arrow in FIG. 1, the vertical motion path of the needle 4, a rotation stopping recess portion 14 is formed on the front surface of the inner shuttle 8. The back side, relative to the direction of rotation of the outer shuttle, of the rotation stopping recess portion 14 is at a phase approximately 15° ahead of the vertical motion path of the needle 4. Also, an upper thread guide surface 15 is formed on the back side, relative to the outer shuttle rotation direction, of the rotation stopping recess portion 14. The upper thread guide surface 15 is formed so that it is progressively diagonally concave to the side along the depth axis of the recess portion 14. A shuttle stopping member 16 is attached substantially horizontally to the bed 1 with a screw 17. On the back side of the end of the shuttle stopping member 16 is disposed a rotation stopping projection 18 that loosely fits against the rotation stopping recess portion 14. The engagement of the rotation stopping projection 18 and the rotation stopping recess portion 14 stops rotation so that the inner shuttle 8 does not rotate in tandem with the outer shuttle 7.

Figure 3:
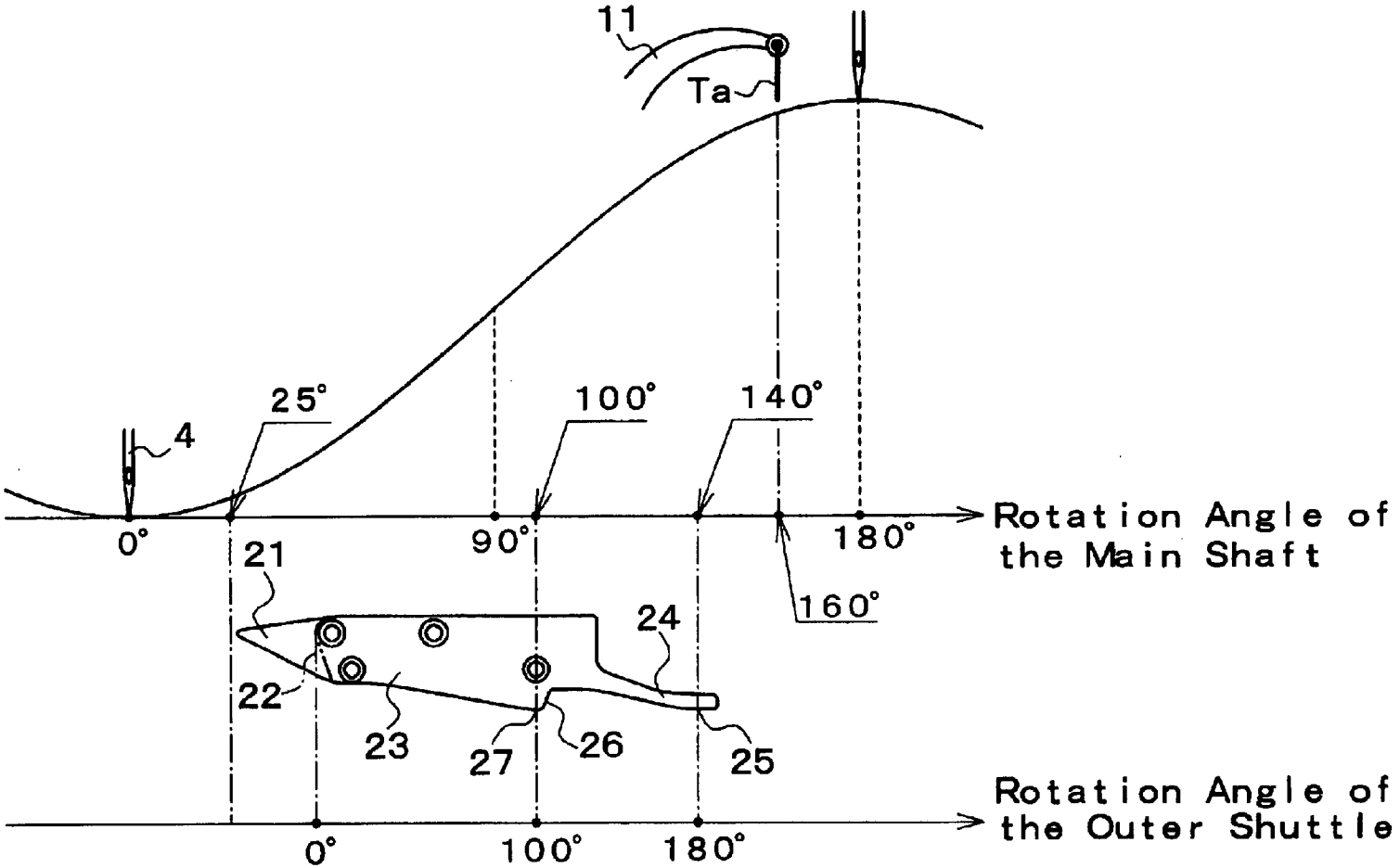
FIG. 3 is a development view of a guide plate shown in association with operations timing of the sewing machine shuttle in terms of the rotation angle of a main shaft according to an embodiment of the present invention.

On the outer perimeter of the outer shuttle 7, there is disposed an upper thread grasping section 22 formed from a tip 20 and an end 21 opening up forward, in terms of the outer shuttle rotation direction. As shown in FIG. 3, the end 21 is formed on the forward section, relative to the outer shuttle rotation direction, of a band-shaped guide plate (generally referred to as a "spring") 23, and a long, thin piece 24 is disposed on the rear section of the guide plate 23. An upper thread release projection 25 is formed as a gentle arc projecting forward on the front edge of the long, thin piece 24. A forward-projecting upper thread advancing projection 27 is also formed on the long, thin piece 24 in front of the upper thread release projection 25, separated by a valley-shaped shelf 26. The upper thread release projection 25 and the upper thread advancing projection 27 are projected so that they protrude forward from the front surface of the inner shuttle 8, but it would be sufficient for them to project at least to a position roughly even with the front surface of the inner shuttle 8 (the remaining section of the front edge of the guide plate 23 is further inward than the front surface of the inner shuttle 8). Alternatively, one of the projections 25 and 27 can be substantially even with the front surface of the inner shuttle 8 while the other protrudes forward from the front surface of the inner shuttle 8. In this embodiment, the tip of the upper thread advancing projection 27 is set up to be at a phase of approximately 80° ahead, in terms of the outer shuttle rotation direction, of the tip of the upper thread release projection 25. When the outer shuttle 7 rotates, the upper thread advancing projection 27 pushes the upper thread Ta ahead of the upper thread release projection 25, and this upper thread Ta is pushed toward the front surface of the inner shuttle 8 (see FIGS. 5A and 5B).

Also, the tip of the upper thread projection 25 is disposed at a phase approximately 180° behind, in terms of the outer shuttle rotation direction, the upper thread grasping section 22. While the upper thread grasping section 22 is grasping and pulling the upper thread Ta, the upper thread release projection 25 pushes forward the upper thread Ta which is dropped into the rotation stopping recess portion 14, thus allowing the upper thread Ta to slide through the abutment between the back side, in terms of the outer shuttle rotation direction, of the rotation stopping recess portion 14 and the rotation stopping projection 18 (i.e., by pushing outward from inside) so that the upper thread Ta is released from the inner shuttle 8 (see FIGS. 7A and 7B). In FIG. 3, the rotation angle of the main axis of the sewing machine is shown as 0° deg where the needle 4 is at bottom dead center. Also, the rotation angle of the outer shuttle 7 is indicated as being 0° where the upper thread grasping section 22 grasps the upper thread Ta in order to facilitate the discussion of relative angles above (note: this 0° position itself rotates). The outer shuttle 7 and the shuttle drive shaft 2 rotate twice for each rotation of the main shaft.

Figure 4:
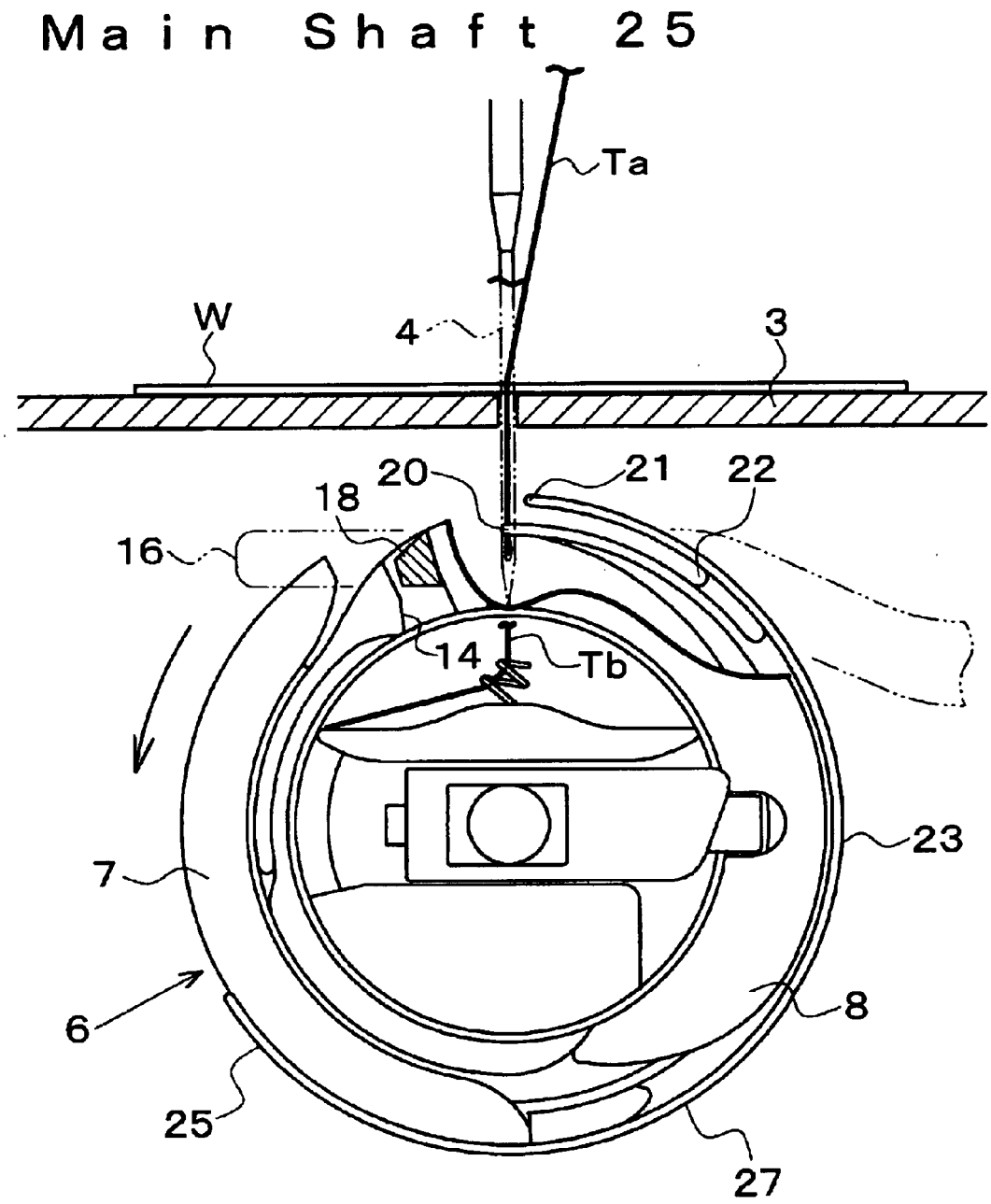
FIG. 4 is an explanatory view showing the operations of a sewing machine shuttle when the main shaft is at a rotation angle of 25° according to an embodiment of the present invention.

Next, the operations performed by the sewing machine shuttle 6 presented above will be described. As shown in FIG. 4, when the needle 4 rises slightly from bottom dead center and the main shaft of the sewing machine reaches a phase of approximately 25°, the tip 20 laterally traverses immediately behind the needle 4 according to the rotation of the outer shuttle 7. The upper thread grasping section 22 grasps and begins pulling the upper thread Ta.

Figure 5A:
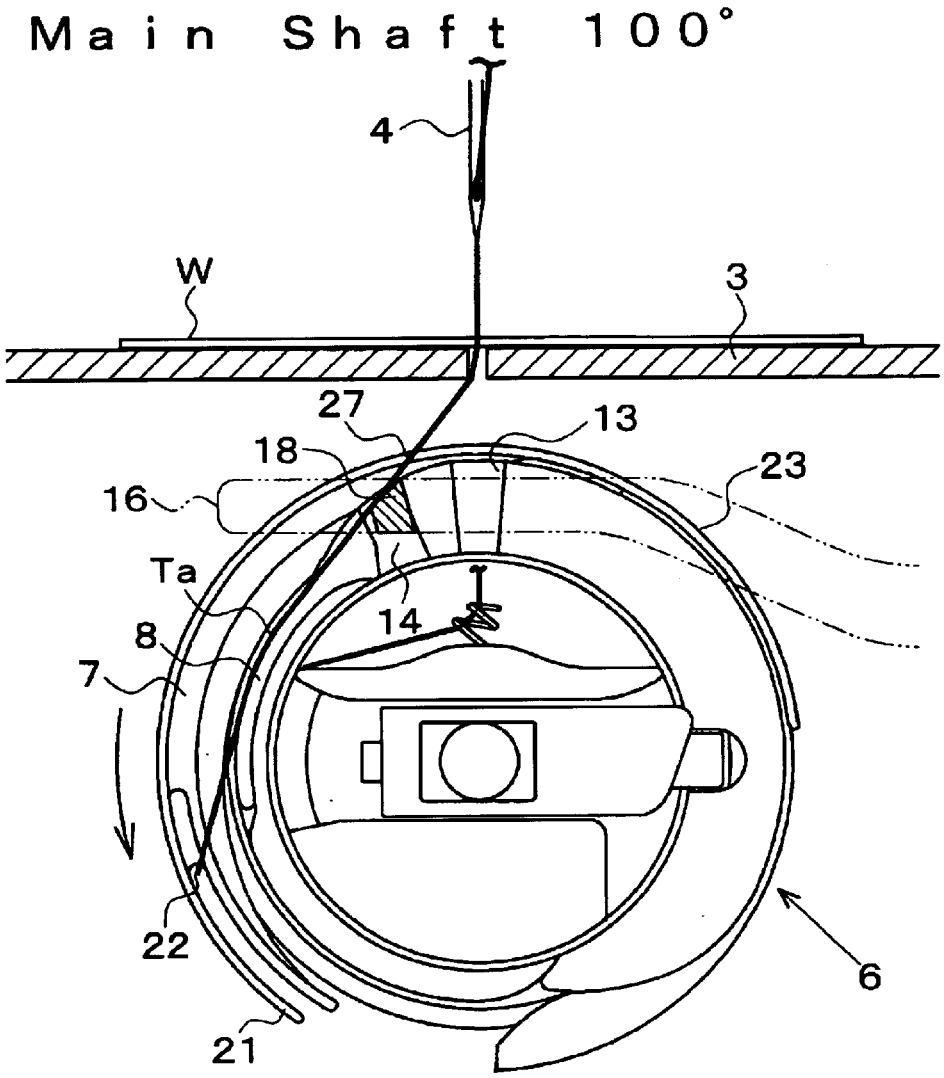
FIGS. 5A and 5B are explanatory views showing the operations of a sewing machine shuttle when the main shaft is at a rotation angle of 100° according to an embodiment of the present invention.
Figure 5B:
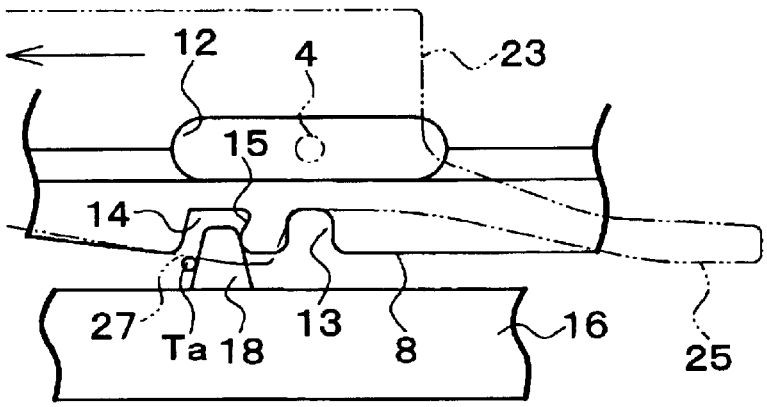

The grasped upper thread Ta is, as shown in FIG. 5A, pulled down along the outer perimeter surface of the inner shuttle 8, and an upper thread loop is formed around the inner shuttle 8. When the main shaft reaches a phase of approximately 100°, the upper thread advancing projection 27 pushes the upper thread Ta forward above the rotation stopping recess portion 14. As shown in FIG. 5B shows, the upper thread Ta is pushed toward the front surface of the inner shuttle 8.

Figure 6A:
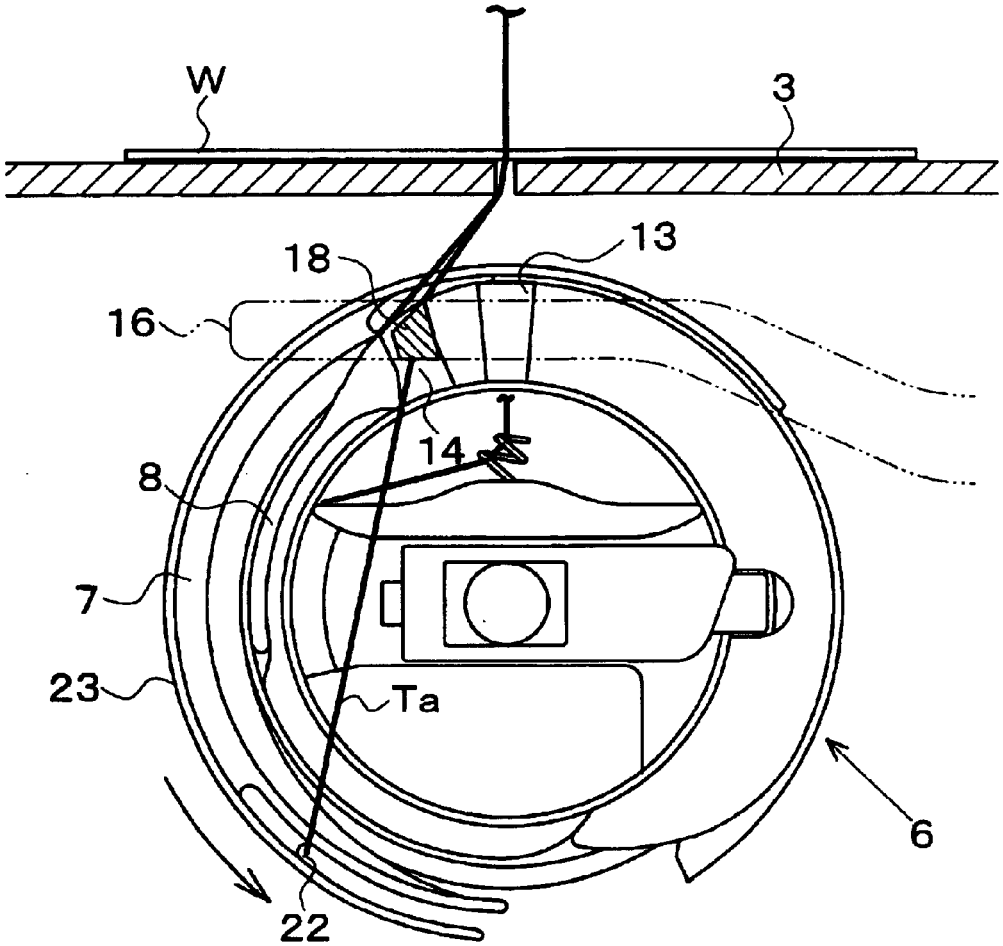
FIGS. 6A and 6B are explanatory views showing the operations of a sewing machine shuttle when the main shaft is at a rotation angle of 115° according to an embodiment of the present invention.
Figure 6B:
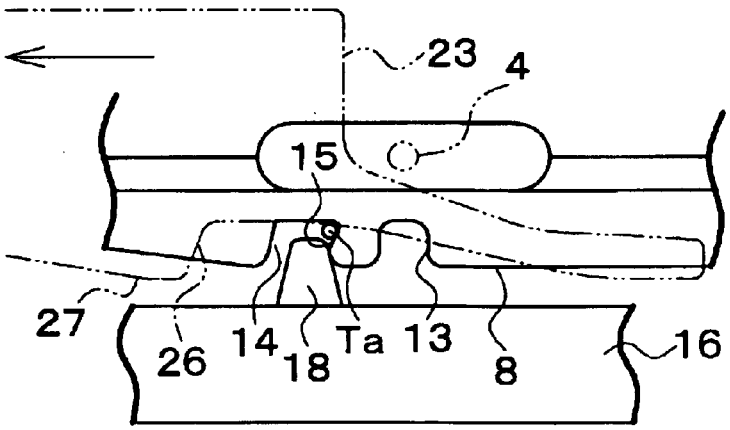

As a result, as shown in FIG. 6A (main shaft at 115° phase), the upper thread Ta is released from the outer perimeter surface of the inner shuttle 8 toward the front surface. As shown in FIG. 6B, the upper thread Ta drops into the rotation stopping recess portion 14 right after the shelf 26 passes the rotation stopping recess portion 14. Then, the upper thread Ta is pulled backward, in terms of the outer shuttle rotation direction, by the tension directed toward the needle 4 because the back side, in terms of the outer shuttle rotation direction, of the rotation stopping recess portion 14 is at a phase approximately 15° (the angle $\alpha$ in FIG. 1) ahead of the vertical motion path of the needle 4. The upper thread Ta reaches the back side, in terms of the outer shuttle rotation direction, enters the concave section of the upper thread guide surface 15 behind the rotation stopping projection 18, and stands by there.

Figure 7A:
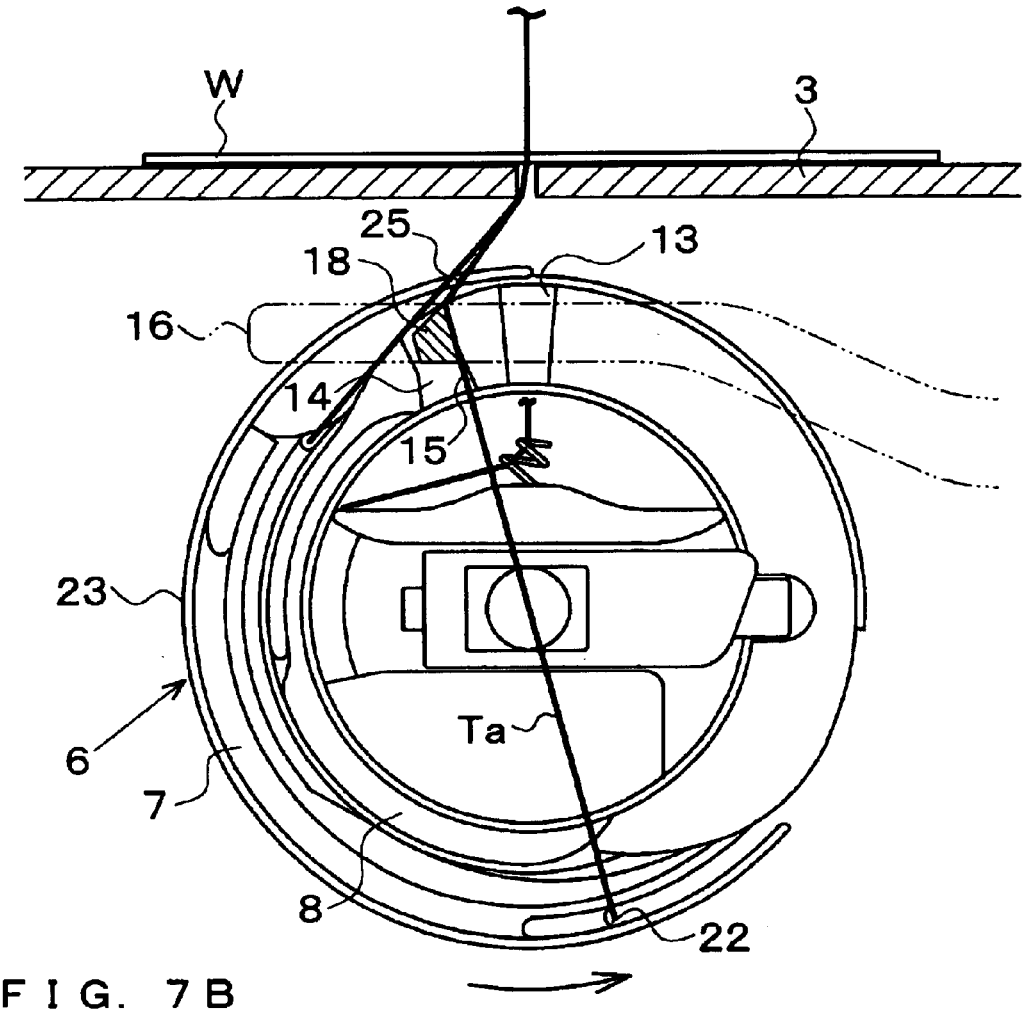
FIGS. 7A and 7B are explanatory views showing the operations of a sewing machine shuttle when the main shaft is at a rotation angle of 140° according to an embodiment of the present invention.
Figure 7B:
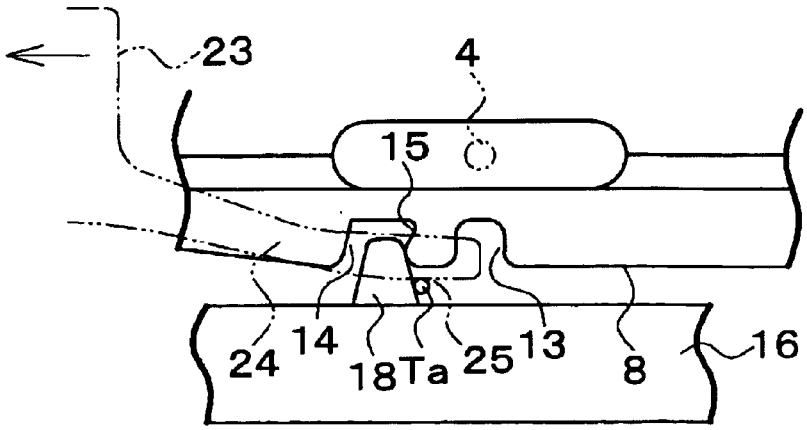

As shown in FIG. 7A, when the main shaft reaches a phase of 140°, the upper thread Ta is at its most extended state across the center of the inner shuttle 8 by the upper thread grasping section 22. From here, the upper thread release projection 25 pushes the upper thread Ta above the rotation stopping recess portion 14 and, as shown in FIG. 7B, the upper thread Ta slides through the abutment between the rear side (in terms of the outer shuttle rotation direction) of the rotation stopping recess portion 14 and rear side of the rotation stopping projection 18. Then the upper thread Ta is released toward the front surface of the inner shuttle 8. As described above, the upper thread Ta can reliably reach the abutment from the standby state at the rear, in terms of the outer shuttle rotation direction, of the rotation stopping recess portion 14 and can also be reliably guided forward to the abutment along the diagonal guide surface 15. Thus, the upper thread Ta can be reliably released from the abutment. Since the rotation stopping recess portion 14 is at a phase of approximately 15° ahead, in terms of the outer shuttle rotation direction, of the vertical motion path of the needle 4, and the phase of the upper thread release projection 25 is 180° behind the upper thread grasping section 22, the upper thread Ta is snapped out from the rotation stopping recess portion 14 while bent at an angle.

Figure 8A:
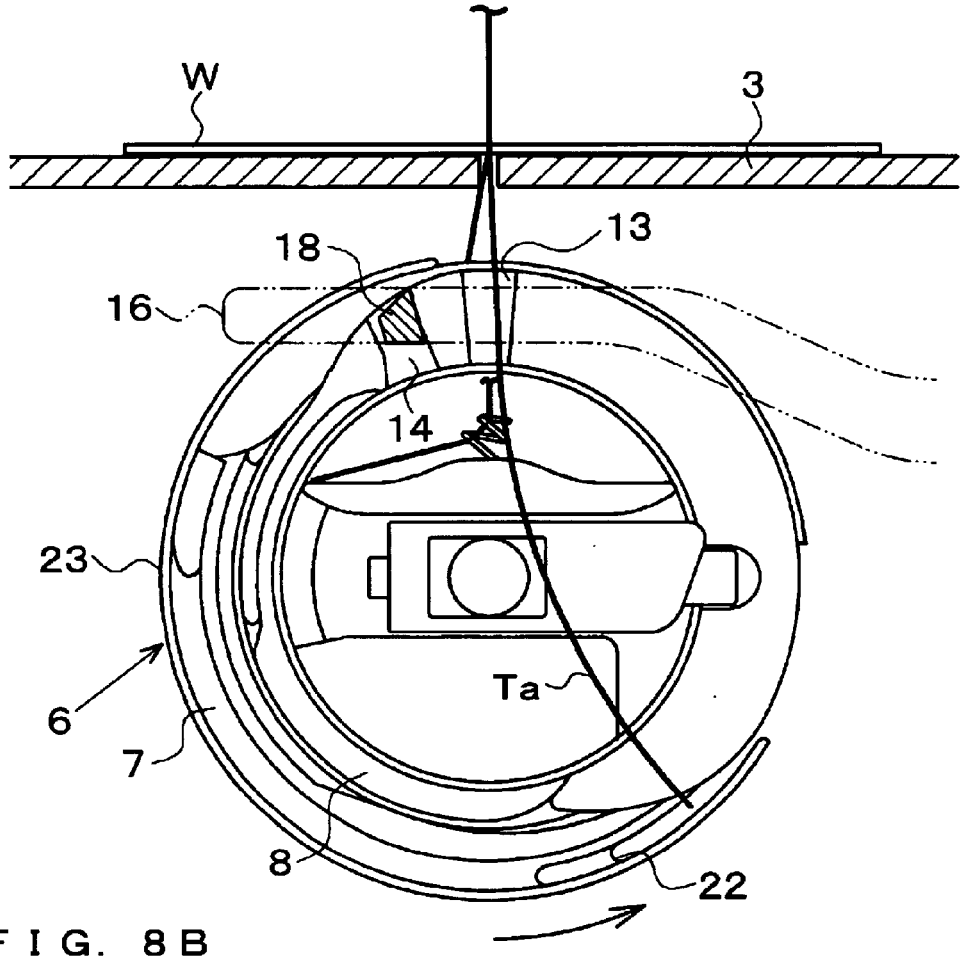
FIGS. 8A and 8B are explanatory views showing the operations of a sewing machine shuttle when the main shaft is at a rotation angle of 145° according to an embodiment of the present invention.
Figure 8B:
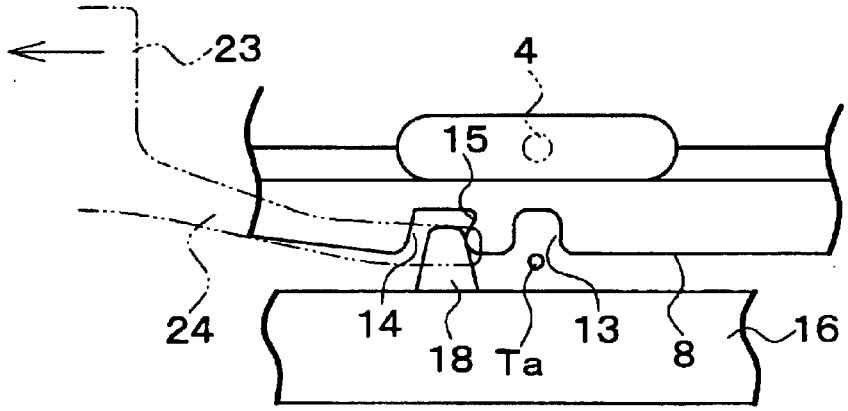

When the upper thread Ta is snapped out from the rotation stopping recess portion 14 in this manner, the upper section of the upper thread loop moves away from the rotation stopping recess portion 14 toward the recess portion 13, and the lower section of the upper thread loop moves away upward from the upper thread grasping section 22, as shown in FIG. 8A (approximately 145° phase of main shaft). As a result, the upper thread Ta can be reliably released from the inner shuttle 8 without engaging it with the rotation stopping recess portion 14. Also, the upper thread tension can be reduced before the take-up lever 11 is pulled up, thus allowing the shape of the upper thread loop to be kept stable. Then, as shown in FIG. 8B, the upper thread Ta stays near the recess portion 13 for a while.

Figure 9A:
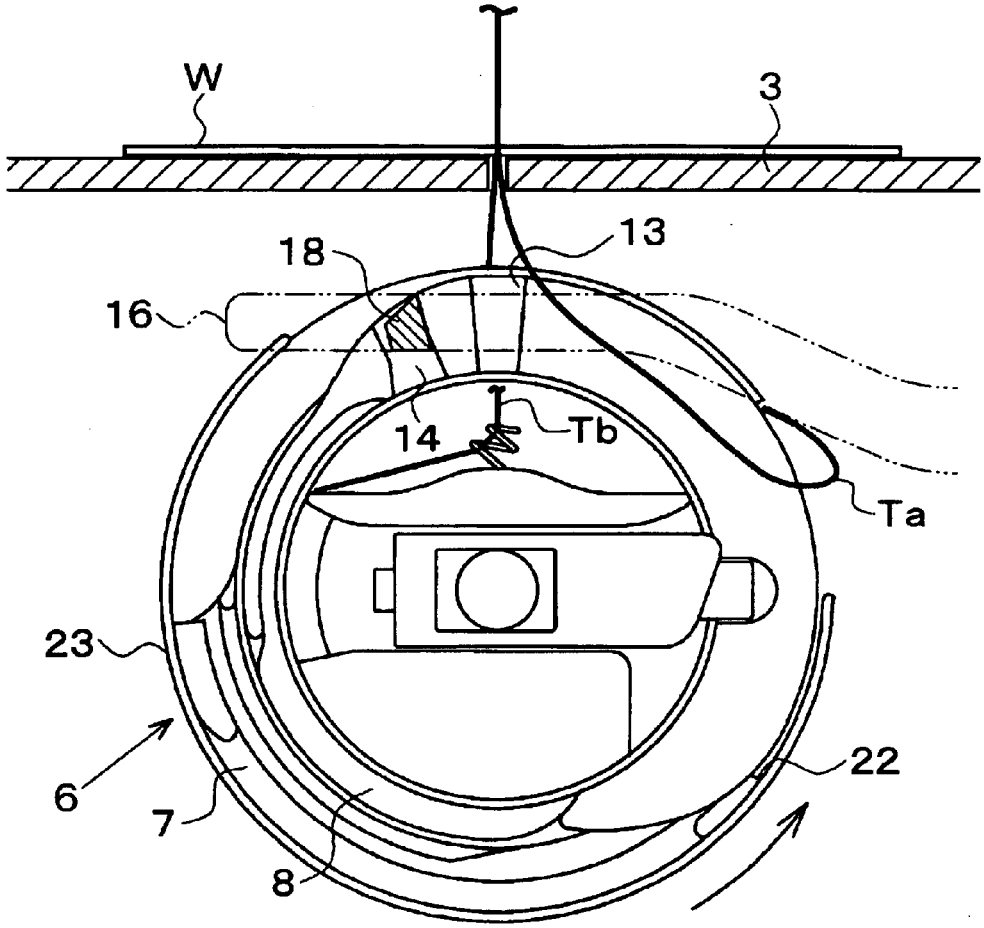
FIGS. 9A and 9B are explanatory views showing the operations of a sewing machine shuttle when the main shaft is at a rotation angle of 160° according to an embodiment of the present invention.
Figure 9B:
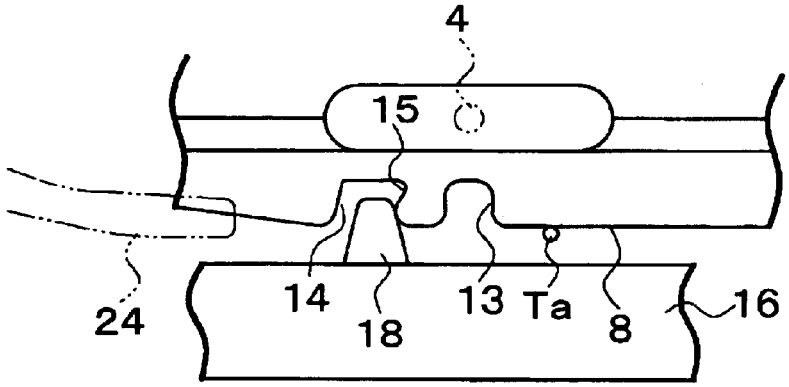
Figure 10A:
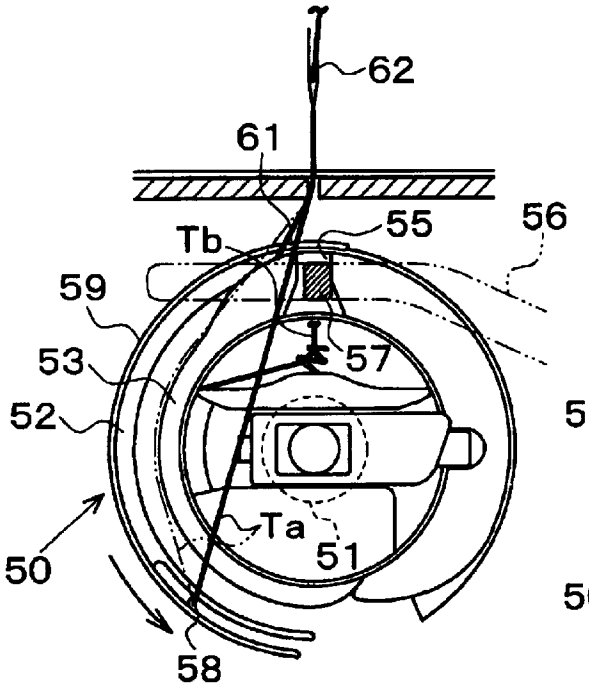
PRIOR ART FIG. 10A
FIGS. 10A to 10C are explanatory views showing the operations of a sewing machine shuttle of the prior art.
Figure 10A:
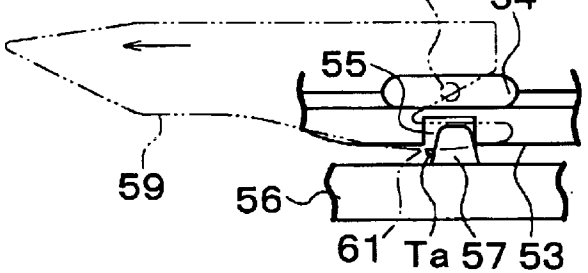
PRIOR ART FIG. 10A
Figure 10B:
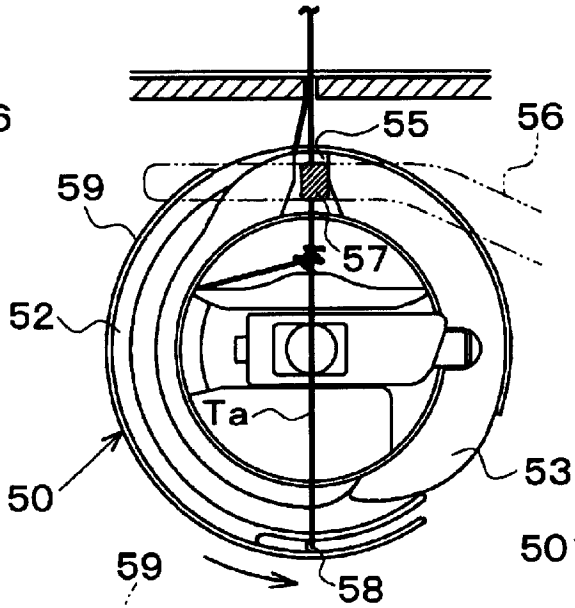
Figure 10B:
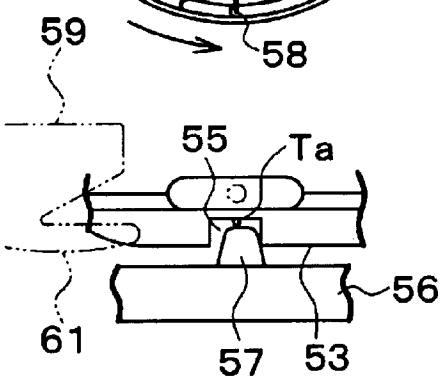
Figure 10C:
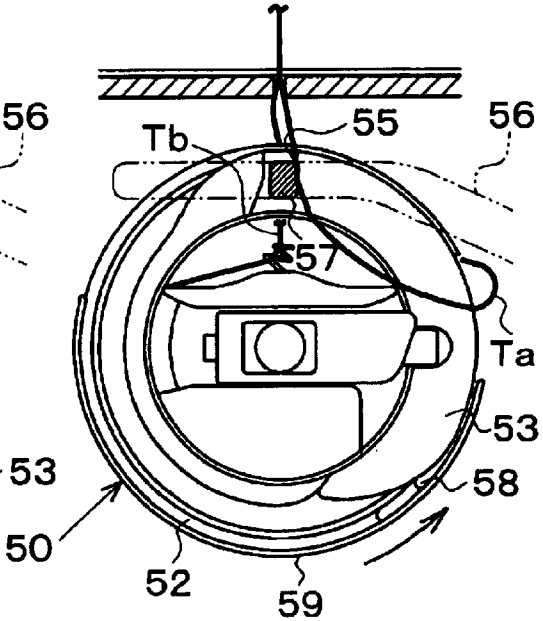
Figure 10C:
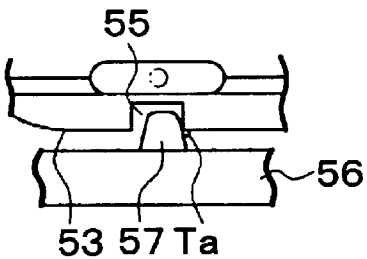
Figure 11A:
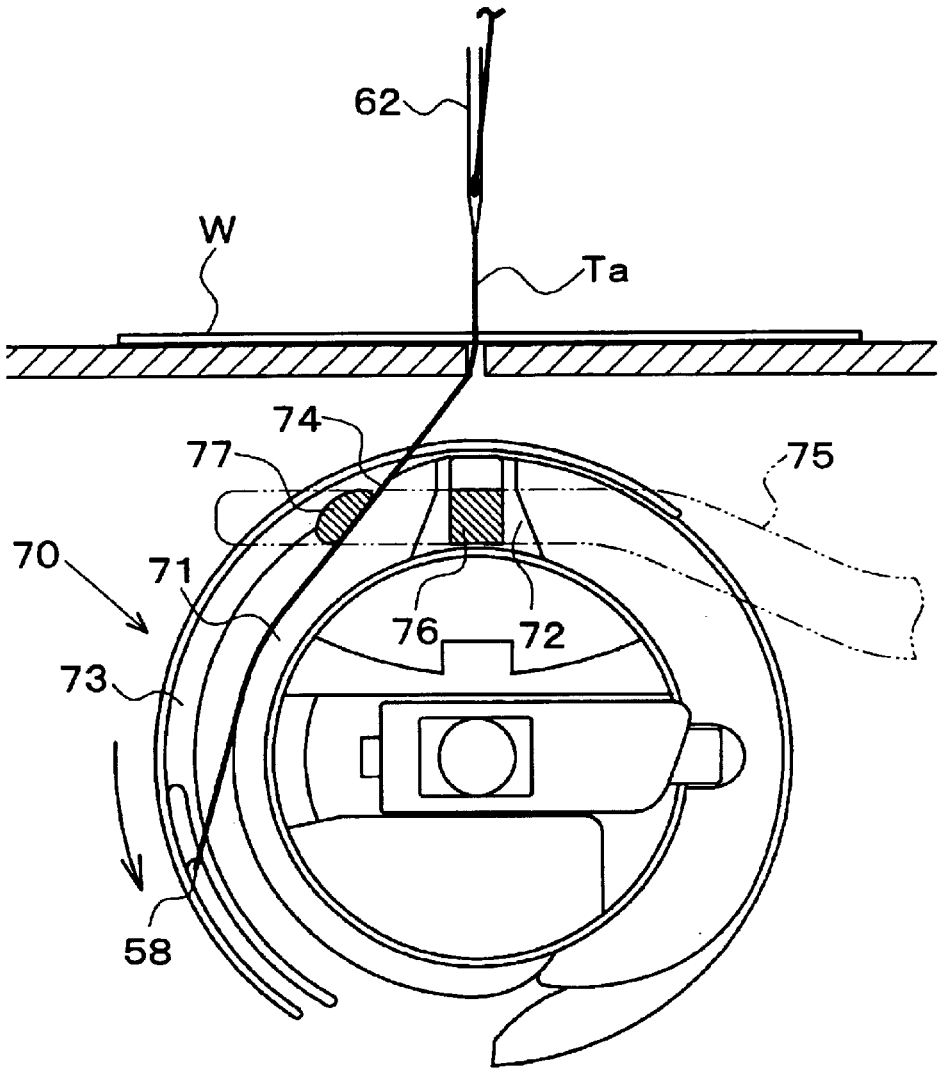
PRIOR ART FIG. 11A
FIGS. 11A and 11B are explanatory views showing the operations of a sewing machine shuttle of another prior art.
Figure 11B:
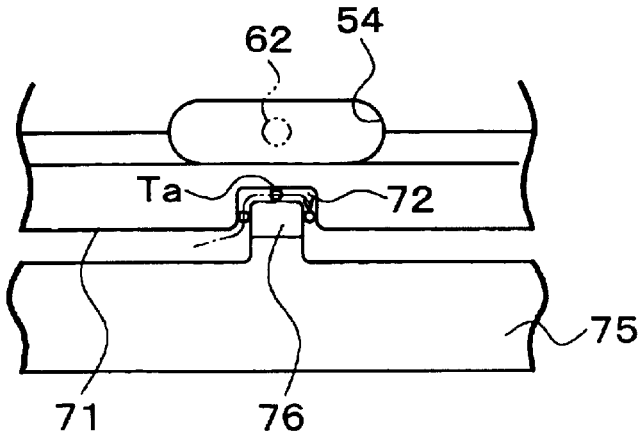

Then, as shown in FIGS. 9A and B, the take-up lever 11 pulls up the upper thread Ta. The upper thread loop contracts, the upper thread Ta and the lower thread Tb engage, and a stitch is formed in the fabric W.

As described above, with the sewing machine shuttle 6 according to this embodiment, the upper thread projection 25 can, following the rotation of the outer shuttle 7, make the upper thread Ta slide through the abutment between the rear side, in terms of the outer shuttle rotation direction, of the rotation stopping recess portion 14 and the rotation stopping projection 18, thus releasing the upper thread Ta from the inner shuttle 8. This can be done prior to the application of the upward pulling force from a take-up lever 11 and without the use of pulling force from the take-up lever 11. Thus, when the pulling force from the take-up lever 11 is applied, there is no resistance generated by the disengagement of the upper thread Ta. This prevents inadequate thread tightness and thread breakage. Also, the behavior of the upper thread Ta after it has been released from the inner shuttle 8 can be made stable, and the upper thread loop shape can be preformed in an even manner so that good, tight stitches are provided. Also, since the rear side, in terms of the outer shuttle rotation direction, of the rotation stopping recess portion 14 and the rotation stopping projection 18 can come into contact with each other, the need to provide a gap between the two or to adjust the gap, as described in JP '566, is eliminated, and, for example, replacement and cleaning of shuttles is made simpler.

The present invention is not restricted to the embodiments described above. For example, the following implementations can be made without departing from the spirit of the invention.

(1) To have elements similar to the upper thread release projection 25 and the upper thread advancing projection 27 from the embodiment described above formed integrally with the front surface of the main unit of the outer shuttle 7 rather than on the guide plate 23.

(2) The recess portion 13 of the inner shuttle 8 is provided as a path for the lower thread Tb, as described above. However, it would also be possible to omit the recess portion 13. In this case, the lower thread Tb would pass directly ahead of the inner shuttle 8.

(3) The rear side, in terms of the outer shuttle rotation direction, of the rotation stopping recess portion 14 is formed at the same phase as the vertical motion path of the needle 4 (0°).

With the sewing machine shuttle according to the present invention as described above, an upper thread can be slipped through the abutment between the rotation stopping recess portion and the rotation stopping projection and released from the inner shuttle before a pulling force from the take-up lever is applied and without the use of this pulling force. When the pulling force fromthe take-up lever is applied, there is no resistance on the upper thread, thus preventing inadequate thread tightness and thread breakage. Also, the behavior of the upper thread after it has been released from the inner shuttle is made stable.

As many apparently widely different embodiments of this invention may be made without departing from the spirit and scope thereof, it is to be understood that the invention is not limited to the specific embodiments thereof except as defined in the appended claims.

What is claimed is:

1. A sewing machine shuttle comprising:

an outer shuttle rotated by a shuttle drive shaft;

an inner shuttle housed in said outer shuttle rotatably relative to said outer shuttle;

an upper thread grasping section disposed on said outer shuttle;

a rotation stopping recess portion formed on a front surface of said inner shuttle;

a shuttle stopping member having a rotation stopping projection, said rotation stopping projection being fitted loosely into said rotation stopping recess portion to allow the rotation of said inner shuttle to be stopped; and an upper thread release projection disposed on a front surface of said outer shuttle, said upper thread release projection projecting forward;

wherein while said upper thread grasping section grasps and pulls said upper thread, said upper thread release projection pushes forward an upper thread which is dropped into said rotation stopping recess portion, thereby making said upper thread slide through an abutment between a rear side, in terms of an outer shuttle rotation direction, of said rotation stopping recess portion and said rotation stopping projection so that said upper thread is released from said inner shuttle.

2. A sewing machine shuttle described in claim 1, wherein said rear side, in terms of said outer shuttle rotation direction, of said rotation stopping recess portion is formed at a phase 0°–40° ahead, in terms of said outer shuttle rotation direction, of a vertical motion path of a needle.

3. A sewing machine shuttle described in claim 1, wherein an upper thread guide surface is disposed on said rear side, in terms of said outer shuttle rotation direction, of said rotation stopping recess portion, said upper thread guide surface being progressively more concave to the side along a depth axis.

4. A sewing machine shuttle described in claim 1, wherein said upper thread release projection is disposed at a phase 160°–190° behind, in terms of said outer shuttle rotation direction, said upper thread grasping section.

5. A sewing machine shuttle described in claim 1, wherein an upper thread advancing projection for pushing forward said upper thread to a front surface of said inner shuttle is disposed on a front surface of said outer shuttle ahead, in terms of said outer shuttle rotation direction, of said upper thread release projection.

6. A sewing machine described in claim 5, wherein said upper thread advancing projection is disposed at a phase 70°–90° ahead, in terms of said outer shuttle rotation direction, of said upper thread release projection.

* * * * *